United States Patent [19]

Yamaguchi et al.

[11] 4,203,408

[45] May 20, 1980

[54] LUBRICATING OIL DETECTOR FOR AN INTERNAL COMBUSTION ENGINE

[75] Inventors: Yoshinobu Yamaguchi; Hitoyuki Takasu, both of Tokyo, Japan

[73] Assignee: Honda Giken Kogyo Kabushiki Kaisha, Tokyo, Japan

[21] Appl. No.: 961,020

[22] Filed: Nov. 15, 1978

[51] Int. Cl.[2] ..... F02B 77/08

[52] U.S. Cl. ..... 123/198 DC; 73/301; 73/308

[58] Field of Search ..... 116/227; 73/299, 301, 73/302; 340/613, 614, 618; 123/198 DC

[56] References Cited

U.S. PATENT DOCUMENTS

| | | | |
|---|---|---|---|
| 2,600,810 | 6/1952 | Lucas | 123/198 S |
| 2,800,648 | 7/1957 | Kelly | 340/614 |
| 3,161,051 | 12/1964 | Perry, Jr. | 73/299 |
| 3,272,011 | 9/1966 | Kendt et al. | 73/299 |
| 3,344,804 | 10/1967 | Lyman | 73/299 X |
| 3,366,100 | 1/1968 | Sapp | 123/198 DC |
| 3,726,140 | 4/1973 | Barbee | 73/299 |
| 3,964,079 | 6/1976 | Katagiri et al. | 340/614 |

FOREIGN PATENT DOCUMENTS

| | | | |
|---|---|---|---|
| 676634 | 2/1930 | France | 73/299 |
| 715806 | 12/1931 | France | 73/299 |

*Primary Examiner*—Daniel M. Yasich

*Attorney, Agent, or Firm*—Irving M. Weiner; Pamela S. Burt; Melvin Yedlin

[57] ABSTRACT

A lubricating oil detector for an internal combustion engine, the detector including a lubricating oil reservoir adapted to be disposed in a chamber of the engine wherein pressure pulsations are produced by reciprocating movement of a piston. An oil level detecting pipe extends to the exterior of a crank case of the engine, the pipe having an end opening at a lowest allowable oil level in the reservoir. A pressure detecting actuator is provided and is adapted to be mounted on the case and connected through a connecting tube to the detecting pipe. When the oil level is below the lowest allowable level, the pressure pulsations in the case are directed to the pressure detecting actuator, which is then actuated to stop the operation of the engine, or to operate an alarm.

12 Claims, 8 Drawing Figures

LUBRICATING OIL DETECTOR FOR AN INTERNAL COMBUSTION ENGINE

BACKGROUND OF THE INVENTION

1. Field of the Invention

The present invention relates to a detector for detecting an insufficient amount of oil in an internal combustion engine so as to stop the operation of the engine, or to give an alarm so as to prevent oil shortages, the oil detection being carried out by a simple structure which utilizes pressure changes in an oil case or oil pan of the engine.

2. Description of the Prior Art

Internal combustion engines for general use have been employed for use as simple, small prime movers such as a stationary engine or a portable generator engine.

Such internal combustion engines are in most cases unattended by personnel during the operation thereof. Further, the operators for such engines are sometimes unskilled, with insufficient knowledge of operation of the engine. Therefore, the engines are very likely to have attendant problems, such as seizures due to oil shortages therein.

One solution to such problems would be to equip the engines with electric oil level meters of the oil level detection type so as to prevent oil shortage. However, such type of meters are generally complicated in structure and relatively costly. The provision of such meters makes the engines more expensive, and use of the oil-level-detection type results in less precise measurements. If a conventional oil lever meter is employed, it will only indicate an amount of oil, and cannot itself detect oil shortages unless the operator reads the meter and confirms such oil shortage. Therefore, the above-mentioned problems which may occur due to oil shortages during unattended operation of the engine will remain unsolved.

The present invention provides a simple and effective solution for detection of oil shortages, which detection has conventionally been difficult to effect on the above-mentioned type of engines.

An important realization which should be noted in connection with the present invention is that internal combustion engines contain oil in the crankcases thereof, pressure pulsations are produced in the crank case by reciprocating movement of a piston of the engine, and such pressure pulsations are utilizable as an actuating medium for a detector.

SUMMARY OF THE INVENTION

The present invention provides a lubricating oil detector for an internal combustion engine, which includes a lubricating oil reservoir adapted to be disposed in a chamber of the internal combustion engine wherein pressure pulsations are produced in the chamber by reciprocating movement of a piston. An oil level detecting pipe is provided and is adapted to extend to the exterior of a crank case of the engine, the pipe including one end thereof opening at a lowest allowable oil level in the reservoir. A pressure detecting actuator is also provided and is adapted to be mounted on the case of the engine. Also provided is a connecting tube adapted to connect the pressure detecting actuator to the detecting pipe.

An object of the present invention is to provide a lubricating oil detector for an internal combustion engine. The detector comprises a lubricating oil reservoir adapted to be disposed in a crank case of the engine in which pressure pulsations are produced by reciprocating movement of a piston, and an oil level detecting pipe leading to the extension of the case, the pipe having an end opening into the oil reservoir. A pressure detecting actuator is provided and is adapted to be mounted on the case and connected to the detecting pipe, the pressure pulsations being led to the actuator through the detecting pipe when the oil level goes below a lowest allowable oil level, and the actuator is made operable by the pressure pulsations to stop the operation of the engine, or to provide an alarm signal.

Another object of the present invention is to provide a lubricating oil detector for an internal combustion engine, characterized in that the detector is simple in construction and requires a minimum number of parts because it comprises only a pipe opening at a lowest allowable oil level, a pressure-energized actuator located outside, and a tubular body connecting the pipe and the actuator together. Thus, the detector can detect oil shortages by simple and inexpensive means.

Still another object of the present invention is to provide an oil shortage detector in which the end of the detecting pipe is located in an oil reservoir in a case and opens into a detecting reservoir communicating with the oil reservoir for detecting oil shortages correctly regardless of changes in oil level due to vibrations of the engine and oil distribution movements. The end of the detecting pipe is smaller in diameter than the remaining portions of the pipe so as to dampen pressure variations with the detecting pipe end in the oil for precise and reliable operation without error.

Yet another object of the present invention is to provide a lubricating oil detector for an internal combustion engine, characterized in that the detecting reservoir is disposed centrally in the oil reservoir. The detecting pipe end opens centrally in the detecting reservoir, and the detecting pipe extends in a direction away from the actuator. The actuator and the detecting pipe are interconnected by a bent pipe, so that the oil is prevented from flowing into the actuator, to thereby prevent malfunctioning of the actuator when the engine is turned over in any direction.

Other objects and advantages of the present invention will become apparent from the following description when read in conjunction with the accompanying drawings which show preferred embodiments by way of illustrative example.

DETAILED DESCRIPTION

Figure 1:
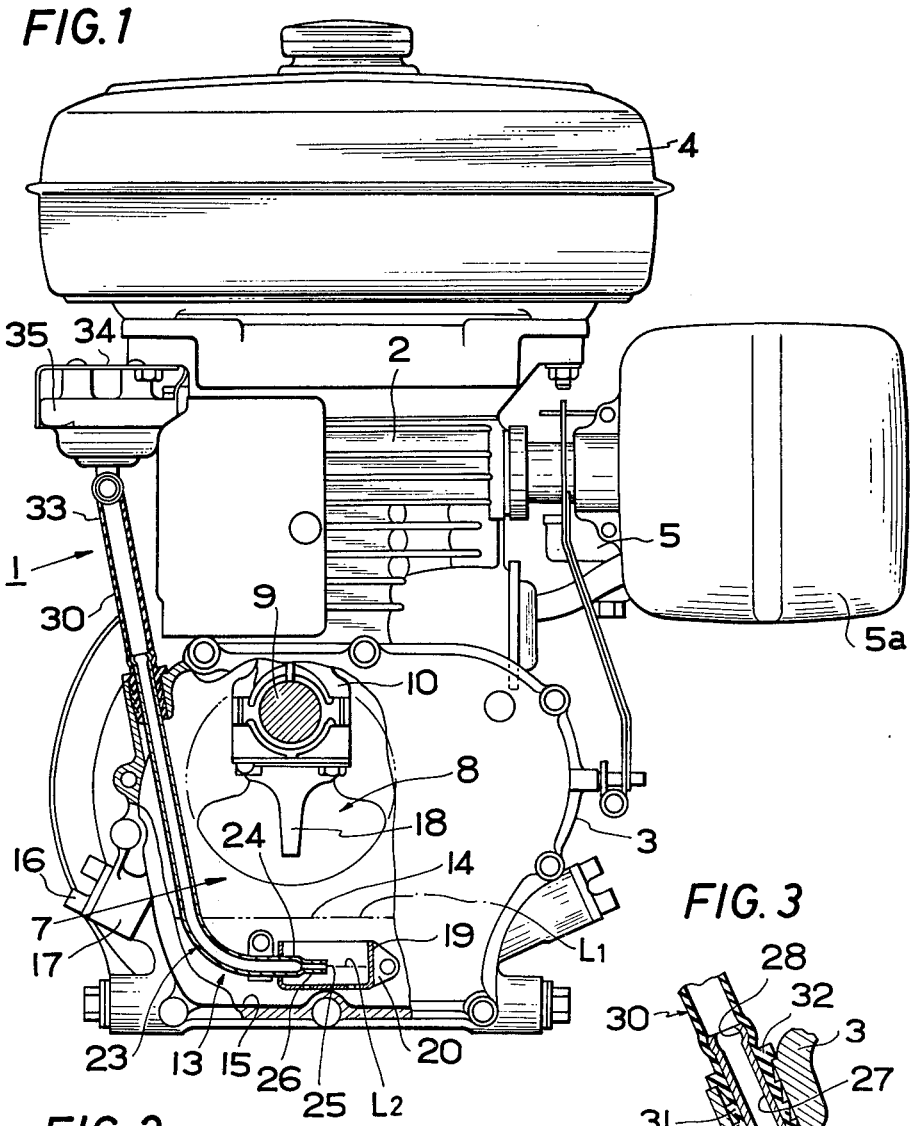
FIG. 1 is a front elevational view, with portions broken away, of an internal combustion engine provided with a detector according to the present invention.
Figure 4:
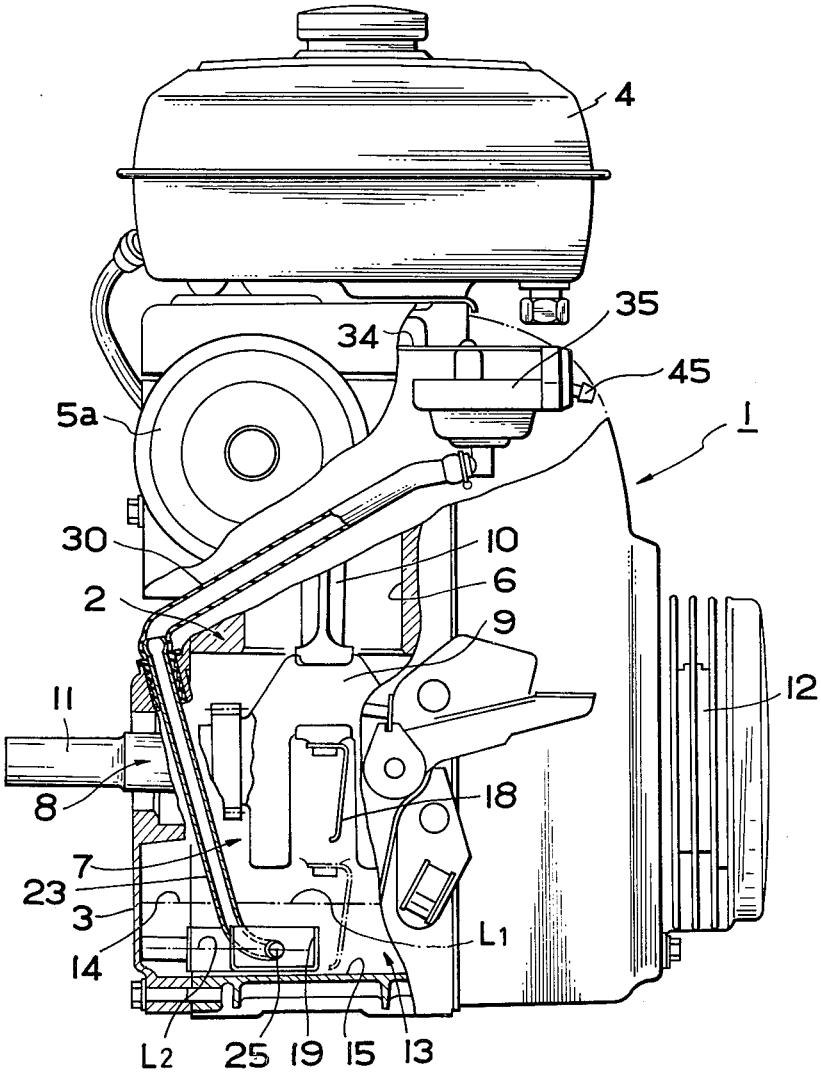
FIG. 4 is an elevational view partially broken away of the engine, as seen in the direction of the arrow 4 in FIG. 1.

With reference to FIGS. 1 and 4, an internal combustion engine 1 for general use according to an illustrated embodiment generally comprises a cylinder block 2, a crank case 3 disposed therebelow, and a fuel tank 4 mounted on top of the cylinder block. The cylinder block 2 supports on its one side a fuel supply unit 5 including an air cleaner and a carburetor for supplying fuel to the cylinder. Also provided is a muffler 5*a*.

The cylinder block 2 has a vertically-extending cylinder 6 therein, which communicates with a chamber 7 in the crank case 3, and in which a piston (not shown) is slidably disposed, the combustion chamber being separated by the piston from the crank chamber 7. A crank shaft 8 rotatably extends through the crank chamber 7 and carries a pin 9 located substantially centrally in chamber 7 and connected through a connecting rod 10 to the piston. The crank shaft 8 has both ends projecting outside the crank case 3, one of the ends acting as an output shaft, to which there may be connected a belt and pulley mechanism, a chain and sprocket mechanism, or gear mechanism as a connecting adapter to an electrical generator, a refrigeration means, a conveyor, or a pump. The other end of the crank shaft 8 is connected to a starter 12 around which a rope may be wound. The operation of the engine can be started by pulling the rope wound around the starter 12.

A lower portion of chamber 7 in crank case 3 functions as a reservoir 13 for lubricating oil 14. The oil 14 has a predetermined level $L_1$ above the bottom 15 of the chamber 7. An oil supply passage 17 (FIG. 1) which is openable and closable by a plug 16 is mounted on a lower part of case 3, the oil being able to be supplied to reservoir 13 by opening plug 16.

Figure 2:
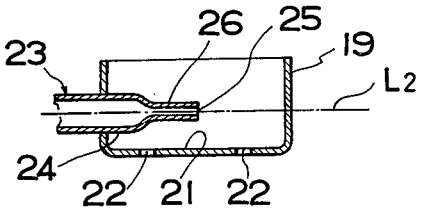
FIG. 2 is an enlarged cross-sectional view of an oil detector reservoir shown in FIG. 1.

Connecting rod 10 has an oppositely-extending dipper 18 for dipping, scooping-up, and distributing the oil 14. The dipper 18 is adapted to go down into the oil 14 upon downward movement of connecting rod 10 connected to the piston, and scoops up and distribues the oil 14 upon upward movement of connecting rod 10. Slightly above the chamber bottom 15 is disposed a cup 19 acting as a detector reservoir and located below the predetermined oil level $L_1$, the cup 19 corresponding in position to a lowest allowable oil level. The cup 19 is supported in such position by a bracket 20 mounted on an inner wall of case 3. The cup 19 has an open top, and a bottom 21 (FIG. 2) having a plurality of through holes 22. The center height of cup 19 corresponds in position to the lowest allowable level $L_2$. The cup 19 is located substantially centrally in chamber 7 within case 3, but out of interference with dipper 18 as shown in FIG. 1.

A detecting pipe 23 has a distal end 24 thereof extending through a peripheral wall of cup 19 and disposed substantially in the heightwise center of cup 19, the distal end 24 having a port 25 opening substantially at a radially central position of cup 19. The port 25 disposed in the cup 19 is disposed in alignment with the lowest allowable oil level $L_2$. The port 25 has a diameter less than that of the remainder of pipe 23, thereby providing a smaller-diameter portion 26 extending over a suitable length interval. The contracted pipe portion 26 prevents pressurized oil from flowing back into the pipe.

Figure 3:
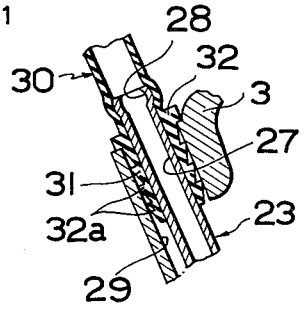
FIG. 3 is an enlarged cross-sectional view of a portion of FIG. 1 in which a detecting pipe, a connecting tube, and a crank case are connected together.

The detecting pipe 23 is bent in an intermediate portion thereof and extends obliquely upwardly, pipe 23 having a base portion 27 (FIG. 3) extending outwardly through a hole 29 in an upper portion of case 3. The base 27 of detecting pipe 23 has a free end which is radially outwardly enlarged to provide an engaging portion 28, which is fitted into a distal end 31 of a flexible tube 30. The end 31 of flexible tube 30 has a flange 32 having a diameter larger than that of hole 29, and also has a number of annular lips 32*a* on the end portion thereof, each lip 32*a* having a larger diameter than that of hole 29. The end of tube 30 is forcibly fitted into hole 29, whereupon the lips 32*a* tightly engage the inner wall of hole 29 for tight sealing. Accordingly, detecting pipe 23 can be held in position, detecting pipe 23 and tube 30 can be connected together, and sealing can be effected, all simultaneously and very easily by simply fitting the distal end portion of tube 30 over base portion 27 of detecting pipe 23, and forcibly inserting the end 31 of tube 30 into hole 29.

A pressure actuator 35 is mounted by a bracket 34 on engine 1 at a suitable position thereon. As shown in FIG. 4, actuator 35 is located at a position spaced from base portion 27 of detecting pipe 23 and is connected to detecting pipe base portion 27 by tube 30, which extends at an angle with respect to detecting pipe 23. The tube 30 and detecting pipe 23 together define a V-shape when viewed from the side.

Figure 5:
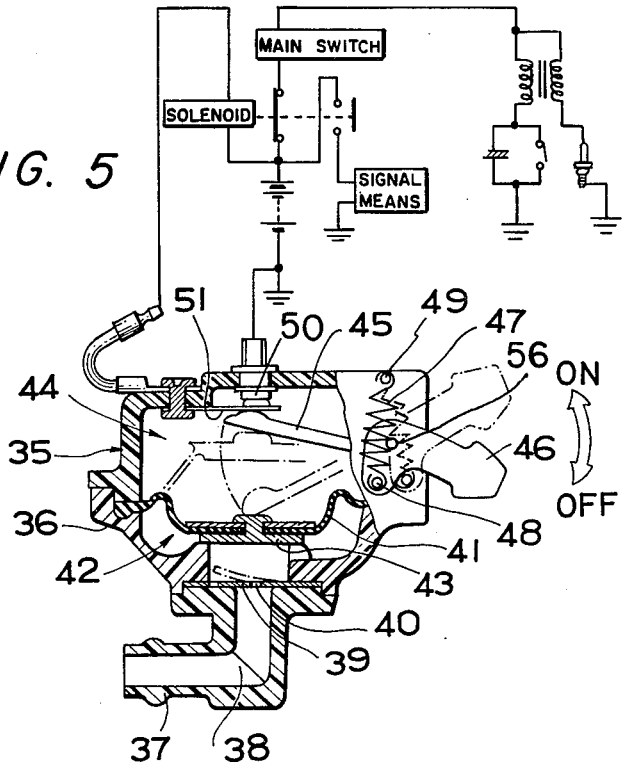
FIG. 5 is a cross-sectional view of an actuator.

With reference to FIG. 5, the actuator 35 has a casing 36 having at the lower portion thereof a connector 37 adapted to be coupled with a base portion 33 of tube 30. The connector 37 has a passage 38 therein in which there is disposed a check valve 39 having an orifice 40 which allows oil leakage under excessive pressure. The passage 38 with valve 39 is disposed in communication with a first lower chamber 42 defined by a diaphragm 41 within casing 36. The diaphragm 41 has at the central portion thereof a presser plate 43 made of a relatively rigid material. An actuator level 45 extends within a second upper chamber 44 and is connected such as by integral forming to a switching lever 46 projecting outwardly from one side of casing 36 and is pivoted at 56, the switching lever 46 being connected by a pin 48 to one end of a click spring 47. The other end of spring 47 is fixed by a pin 49 to the above-mentioned one side of casing 36. The casing 36 supports a contact 50 and a terminal 51 on the top cover thereof. When contact 50 and terminal 51 are separated from each other, i.e., when switching lever 46 is in a normal upper position with actuator lever 45 being in a normal lower position, an ignition circuit is closed to allow the engine to continue running. In this state, spring 47 engaged between pins 48 and 49 is located outwardly with respect to pivot 56 to keep switching lever 46 in the upper position. Conversely, when switching lever 46 is displaced downwardly, actuator lever 45 is shifted upwardly to raise terminal 51 into contact with contact 50, whereupon the ignition circuit is opened or grounded, thereby stopping the operation of the engine. In this state, spring 47 is located inwardly with respect to pivot 56 to keep switching lever 46 in the lower position. Consequently, the operation of the engine is held on or off by click spring 47.

Figure 6:
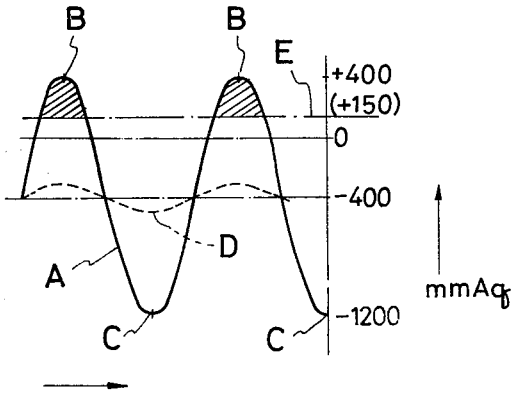
FIG. 6 is a graph showing pressure fluctuations in the detecting pipe and the connecting tube.

During operation of the engine, the pressure within the crank case 7 becomes alternately positive and negative with reciprocating movement of the piston, producing pressure pulsations. As shown in FIG. 6, the pressure within the chamber 7 varies according to a sine wave represented by the solid line A. When the piston reaches the bottom dead center B, the pressure above the oil becomes positive, and when the piston reaches the top dead center C, the pressure above the oil becomes negative. The pressure within the oil varies to a much lesser degree as seen from the dotted line D. This is because pressure fluctuations are taken up by the dampening effect of the oil.

As mentioned hereinabove, port 25 of detecting pipe 23 is located at the lowest allowable oil level $L_2$. When oil 14 is maintained at the level $L_1$, the cup 19 and port 14 are immersed in oil 14, at which time the pressure within detecting pipe 23 is far below an actuating pressure level E for the actuator, which level is close to the pressure at top dead center. Although the surface of the oil changes in level and becomes wavy when dipper 18 is plunged into and lifted out of the oil for dipping, the detecting pipe port 25 is located within cup 19 disposed in communication with reservoir 13. With the oil surface changing in level, therefore, an oil level to be measured is maintained to be calm relative to the other oil surface. The air within detecting pipe 23 tends to be pressurized under oil pressure when dipper 18 is plunged into the oil. However, because the small diameter port 25 dampens pressure pulsations in the oil, the actuator 35 is prevented from being operated in error. The detecting pipe 23 is of a relatively large diameter except for the distal end portion thereof, thereby facilitating the exchange of oil for air. With such structure, an amount of air in tube 30 and pipe 23 is large for an increased degree of dampening acting on oil that has been raised. However, too large a diameter of pipe 23 causes oil pressure pulsations in the case to become dampened during operation. Therefore, it is preferable to suitably determine the diameters of pipe 23 and of the end portion thereof with the foregoing conditions being taken into consideration.

With cup 19 communicating through holes 22 with reservoir 13 and detecting pipe port 25 opening into cup 19, sudden oil pressure increases due to the impact of the dipper 18 on the oil are prevented from causing adverse effects. Furthermore, temporary oil level changes due to engine vibrations or impacts are taken up, to permit reliable and stable measurement of an amount of oil. In addition, because cup 19 acting as a detector is disposed centrally of oil reservoir 13, an actuating oil level is constant at all times even if the engine is tilted back and forth or laterally.

When the oil is reduced in amount to the lowest allowable level $L_2$, the detecting pipe port 25 in cup 19 emerges out of the oil and becomes exposed. Under this condition, the interior of detecting pipe 23 is held in communication with the interior of crank chamber 7, whereupon the pulsating pressure acts through the detecting pipe 23 and tube 30 on actuator 35. The check valve 39 in passage 38 in actuator 35 is opened when the pulsating pressure becomes positive, and is closed when the pulsating pressure becomes negative. The opening and closing movements of valve 39 allow pressure to build up in the lower chamber 42, thereby causing diaphragm 41 to move upwardly. Diaphragm 41, switching lever 46, spring 47, contact 50, and terminal 51 combine to define means for stopping operation of the engine as follows. The upward movement of diaphragm 41 causes the actuating lever 45 to shift upwardly, whereupon the lever 46 becomes displaced downwardly under the force from the click spring 47 moved inwardly with respect to pivot 56, permitting contact 50 to contact terminal 51. Thus, the operation of the engine is brought to a stop.

As mentioned above, when the oil is reduced to the lowest allowable level, the condition is detected, and the actuator is operated by the pressure pulsations in the crank case to stop the operation of the engine. Accordingly, various problems, such as seizure, are prevented from occurring while the engine is running with an insufficient supply of oil. If switching lever 46 is shifted upwardly to separate terminal 51 from contact 50 in an attempt to start the operation of the engine, the above-mentioned actuating operation will be repeated and the engine will not start operating as long as the oil is maintained at the lowest level $L_2$, or unless a supply of oil is added. By supplying oil until the level in the case rises above the lowest level $L_2$ to allow detecting pipe port 25 to become immersed in the oil, normal continuous operation of the engine is permitted.

While in the above description the actuator is used only to de-energize the engine, it is also possible to connect a signal means (FIG. 5) such as a buzzer or lamp to the actuator, and to detect when the engine is running low on oil by the turning-on of the buzzer or the lamp upon energization of the actuator. The connection of the actuator with the engine and/or the signal means can be alternatively or jointly used in practice. The circuit diagram illustrated in FIG. 5 shows signal means incorporated in a circuit for de-energizing the engine, by way of example. Such circuit as depicted in FIG. 5 includes an exemplary conventional arrangement of a solenoid, a main switch, and a signal means, arranged such that the signal means is energized when the ignition circuit is opened or grounded.

Figure 7:
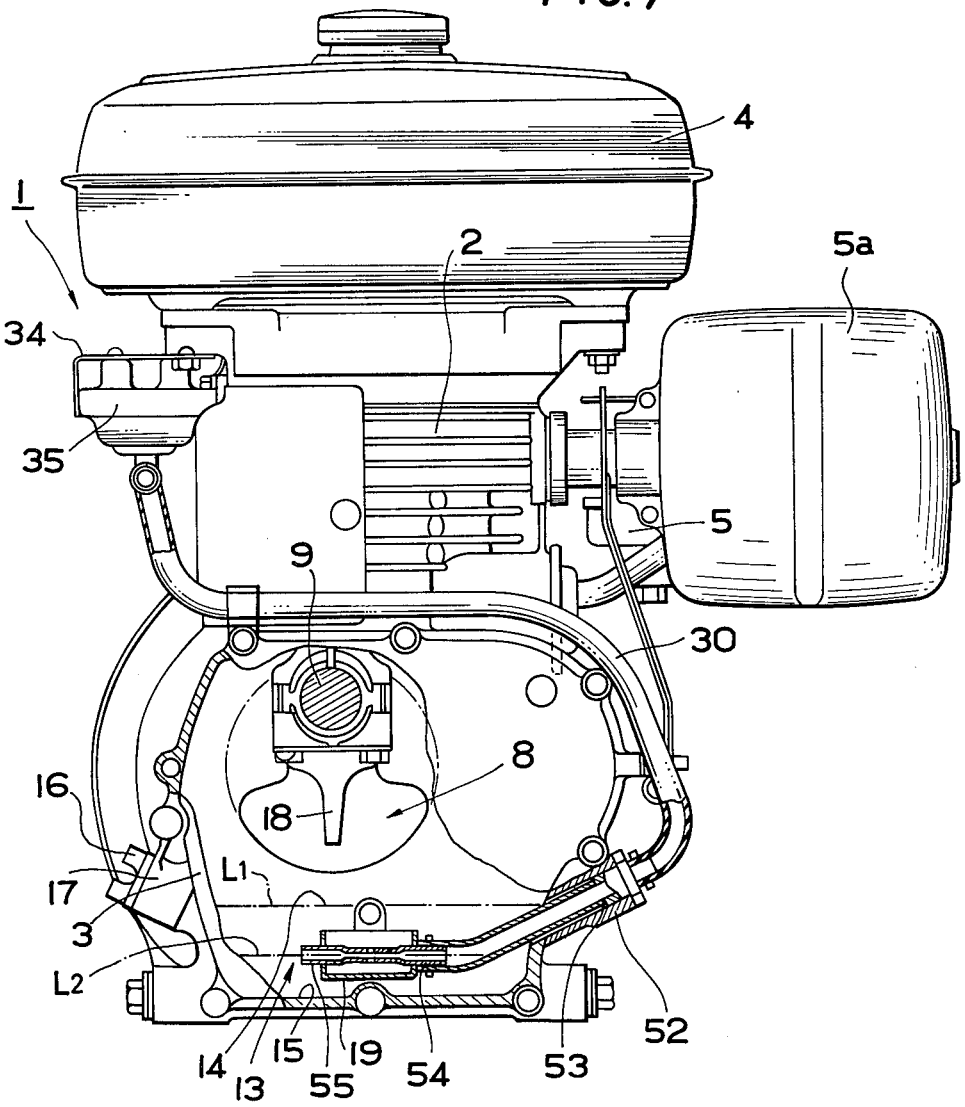
FIG. 7 is a view similar to FIG. 1, illustrating a modification according to the invention.

FIG. 7 shows a modification in which same reference numerals are used to denote the same parts as those in the preceding described embodiment.

According to this modification, an oil level detector 52 which is located in opposed relation to the oil supply passage 17 has a level gauge pipe 53 to which is connected a pipe 54 having a distal end which is of the same structure as that of detecting pipe 23 coupled to cup 19. The pipe 53 projects outside level detector 52 and is connected to an end of tube 30. With this arrangement, the level gauge pipe 53 becomes part of detecting pipe 54 and acts as a coupling between tube 30 to actuator 35 and detecting pipe 54, thereby functioning as a level gauge. A detecting pipe 55 extending in a direction opposite to detecting pipe 54 acts as a detector. Thus, this modification is provided with a level gauge and a detector which function independently. The detecting pipes 54, 55 may comprise a single tubular body with a reduced diameter portion having a central opening, or may comprise separate tubular bodies with reduced diameter portions opposed to and spaced from each other. The tube 30 is bent where it is connected to detector 52, extends horizontally, and extends upwardly for connection to actuator 35.

Both of the above described embodiments prevent oil from flowing into actuator 35 when engine 1 is turned over. More specifically, when engine 1 of FIG. 1 is turned over with the left side down, port 25 of detecting pipe 23 is directed upwardly at a central position and is located well above the oil level. Thus, the oil is prevented from flowing through pipes 23, 30 into actuator 35. With the engine turned over with the right side down, no oil flows up through the pipes and no problem arises.

When the engine of FIG. 4 is turned over with the left side down, the V-shaped connection of pipes 23, 30 prevents the oil from entering actuator 35. When the engine is turned over with the right side down, no oil flows up through the pipes. Accordingly, no oil is permitted to go into the actuator and no malfunctioning of the actuator occurs, regardless of the direction in which the engine is turned over.

When the engine of FIG. 7 is turned over with the right side down, no oil is allowed into actuator 35 with the piping as illustrated.

Figure 8:
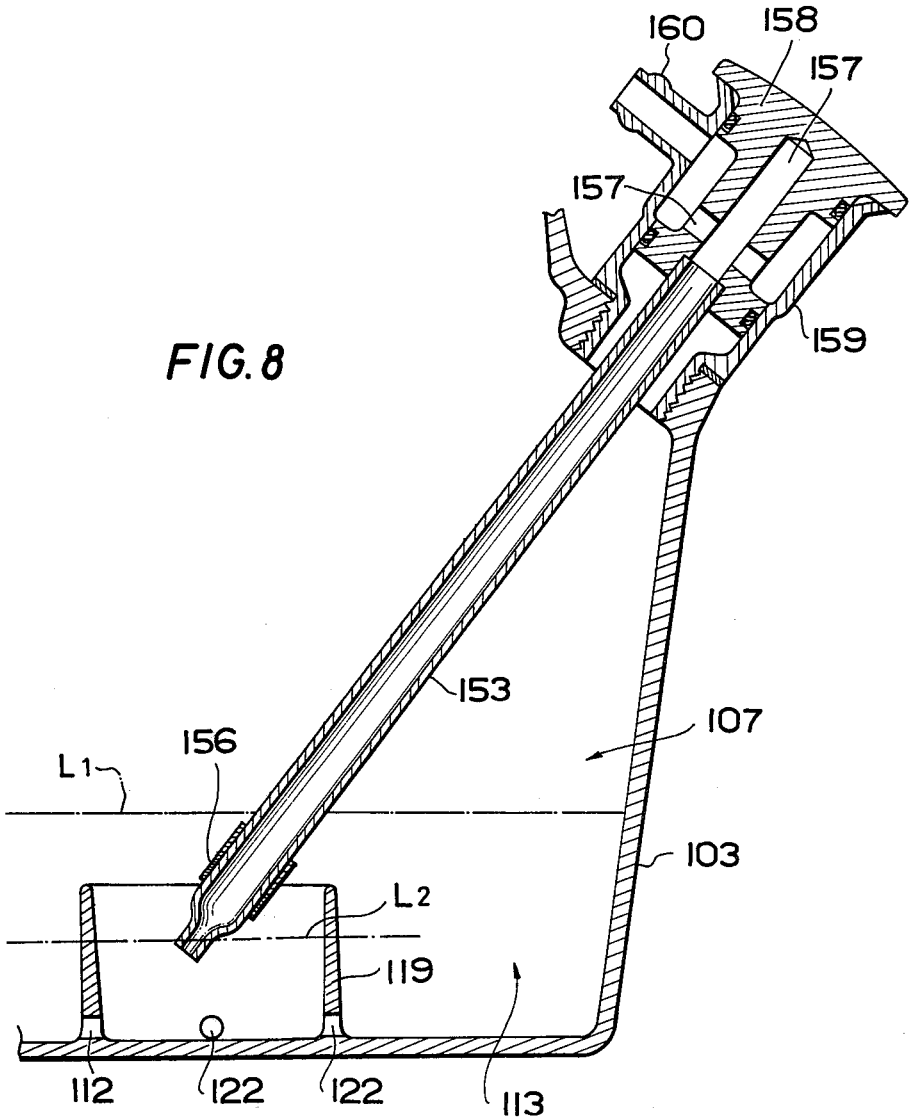
FIG. 8 is an enlarged cross-sectional view of a modified detecting pipe utilized as an oil level gauge.

According to another modification shown in FIG. 8, a cup 119 with an open top is disposed directly on the bottom 115 of a chamber 107 of a case 103, the cup 119 communicating through lower holes 122 with an oil reservoir 113. A tubular level gauge 153 has an open end located at the lowest allowable level $L_2$. The pipe 153 is provided with a marking 156 there-around at a position above the level $L_2$, the pipe 153 having an upper end connected to a cap 158 having inner passages 157. The cap 158 is detachably fitted in a joint 159 threadedly extending through the case 103. The joint 159 includes a connector tube 160 connected to the tube leading to the actuator. The pipe 153 can be taken out by pulling the cap 158 so as to examine the marking 156 for an amount of remaining oil. The fact that the oil has been reduced to the lowest level can be detected through the inner passages.

Although the present invention has been described in detail hereinabove, it should be understood that various changes and modifications can be made therein without departing from the scope of the appended claims.

We claim:

1. A lubricating oil detector for an internal combustion engine, comprising:

a lubricating oil reservoir adapted to be disposed in a chamber of an internal combustion engine wherein pressure pulsations are produced by reciprocating movement of a piston of the engine;

an oil level detecting pipe adapted to extend to the exterior of a crank case of the engine;

said pipe including one end thereof opening in said reservoir;

a pressure detecting actuator adapted to be mounted on the case of the engine, said actuator including valve means;

a connecting tube adapted to connect said valve means of said pressure detecting actuator to said detecting pipe;

said one end of said pipe being disposed in alignment with a predetermined lowest allowable level of oil in said reservoir such that when the oil level in said reservoir falls below said predetermined level said one end of said pipe becomes substantially exposed above the surface of the oil to communicate with said chamber of said engine, whereby the pulsating pressure in said chamber acts through said detecting pipe and said connecting tube to open and close said valve means of said pressure detecting actuator;

said actuator including a first chamber cooperating with said valve means such that pressure is built up therein in response to opening and closing of said valve means; and said actuator further including means for stopping operation of said engine in response to pressure built-up in said first chamber of said actuator when the oil level in said reservoir falls below said predetermined level.

2. A lubricating oil detector according to claim 1, wherein:

said one end of said detecting pipe is located substantially centrally within said oil reservoir.

3. A lubricating oil detector according to claim 1, wherein:

said one end of said detecting pipe has a smaller diameter than the diameter of the remaining portion of said pipe, defining a contracted pipe portion to prevent pressurized oil from flowing back into said detecting pipe.

4. A lubricating oil detector according to claim 1, further comprising:

a cup-shaped oil level detecting reservoir substantially disposed in said oil reservoir, said cup-shaped reservoir having an open top;

said oil level detecting reservoir being provided with a through hole in the lower portion thereof; and said one end of said detecting pipe being disposed in said oil detecting reservoir.

5. A lubricating oil detector according to claim 1, wherein:

the other end of said detecting pipe is adapted to be extended to the exterior of the case of the engine; and said connecting tube includes a flexible portion thereof sealingly fitted over said other end of said detecting pipe.

6. A lubricating oil detector according to claim 1, further comprising:

an oil level gauge pipe connected between said detecting pipe and said connecting tube.

7. A lubricating oil detector according to claim 1, wherein:

said detecting pipe is adapted to be inserted through the case of the engine and to define an oil level gauge.

8. A lubricating oil detector according to claim 1, wherein:

said one end of said detecting pipe opens centrally into said oil reservoir;

said detecting pipe extends in a direction away from said actuator; and said detector further includes a bent connector pipe connecting said actuator to said detecting pipe.

9. A lubricating oil detector according to claim 3, wherein:

said detector further includes a cup-shaped oil level detecting reservoir substantially disposed in said oil reservoir, said cup-shaped reservoir having an open top;

said oil level detecting reservoir is provided with a through hole in the lower portion thereof; and said one end of said detecting pipe is disposed in said oil detecting reservoir.

10. A lubricating oil detector according to claim 1, wherein said means for stopping operation of said engine in response to pressure built-up in said first chamber of said pressure detecting actuator comprises:

a diaphragm separating said first chamber of said actuator from a second chamber of said actuator;

an actuator lever cooperating with said diaphragm and extending within said second chamber of said actuator;

said diaphragm being moved upwardly in response to pressure built-up in said first chamber of said actuator so as to shift said actuator lever upwardly; and said actuator lever cooperating with a terminal movable by upward shifting of said actuator lever into contact with a contact for opening the ignition circuit of said engine to stop operation thereof.

11. A lubricating oil detector according to claim 10, herein:

said actuator lever is connected to a switching lever which projects outwardly from a casing of said actuator;

said switching lever is connected to a spring for holding said switching lever in a normal upper position; and said actuator lever is held in a normal lower position by said switching lever in said normal upper position such that said terminal is separated from said contact to close said ignition circuit of said engine.

12. A lubricating oil detector according to claim 11, wherein:

said spring is disposed outwardly relative to a pivot connection of said switching lever when said switching lever is held in said normal upper position thereof, and is disposed inwardly relative to said pivot connection of said switching lever when said switching lever is moved to a lower position thereof.

* * * * *